United States Patent [19]

Abe et al.

[11] Patent Number: 4,501,621

[45] Date of Patent: Feb. 26, 1985

[54] METHOD FOR REMOVING A SELENIUM LAYER FROM A SUBSTRATE

[75] Inventors: Naoto Abe; Hidetoshi Akimoto; Hiroyuki Nomori, all of Hachioji, Japan

[73] Assignee: Konishiroku Photo Industry Co., Ltd., Tokyo, Japan

[21] Appl. No.: 513,257

[22] Filed: Jul. 13, 1983

Related U.S. Application Data

[63] Continuation of Ser. No. 274,315, Jun. 16, 1981, abandoned.

[30] Foreign Application Priority Data

Jun. 23, 1980 [JP] Japan ..... 55-83946
Jun. 30, 1980 [JP] Japan ..... 55-86084

[51] Int. Cl.[3] ..... B08B 3/10; B08B 7/04
[52] U.S. Cl. ..... 134/17; 134/35
[58] Field of Search ..... 134/16, 17, 34, 35

[56] References Cited

U.S. PATENT DOCUMENTS

| | | | |
|---|---|---|---|
| 1,898,809 | 2/1933 | Berg | 134/17 X |
| 3,056,700 | 10/1962 | Osterlin | 134/17 |
| 3,419,427 | 12/1968 | Plock | 134/17 X |
| 3,455,737 | 7/1969 | Seibert | 134/17 |
| 3,743,692 | 7/1973 | Vinton et al. | 134/17 X |
| 3,837,815 | 9/1974 | Bixby | 134/17 X |
| 3,990,907 | 11/1976 | Endo et al. | 134/17 X |
| 4,257,820 | 3/1981 | Jacobs | 134/38 X |

*Primary Examiner*—Marc L. Caroff
*Attorney, Agent, or Firm*—Jordan B. Bierman

[57] ABSTRACT

A coating layer, such as a photosensitive selenium coating is removed from a substrate by producing cracks in the layer, introducing a volume expansive material into the cracks, and then causing the volume expansive material introduced into the cracks to expand and thereby dislodge the coating layer from the substrate.

9 Claims, No Drawings

METHOD FOR REMOVING A SELENIUM LAYER FROM A SUBSTRATE

This application is a continuation of application Ser. No. 274,315 filed June 16, 1981 now abandoned.

The present invention relates to a method for removing from a substrate a coating layer formed on the surface thereof.

In general, a coating layer is formed on the surface of a substrate for the purpose of obtaining a specific function in said layer itself, protecting the surface of said substrate, or for various other purposes, but it is needless to say that, with the exception of special purposes, such coating layer is formed so as to securely adhere to the surface of said substrate, or so that the coating layer itself is strong and has a large durability. It is, therefore, usually not easy to remove the coating layer formed on the surface of a substrate.

However, in the case where the coating layer has become unable to fulfil its objective function, if the substrate is still usable, the formation of a new coating layer on the same substrate to restore the same function is very economically advantageous.

A typical example of such cases as described above is the photoconductive selenium light-sensitive body provided for the electrophotographic process.

The selenium light-sensitive body comprises a conductive support as a substrate which is provided on the surface thereof with a coating layer, a light-sensitive layer, having as a principal component a non-crystalline selenium or selenium alloy. However, although there may be used as the foregoing support such metals as, in general, aluminum, steel, stainless steel, brass and the like, the use of such support is extremely expensive due to the fact that the support requires the use of a specific material in order to obtain good image forming characteristics including the adherence with a light-sensitive layer to be formed on the support, the surface condition of the light-sensitive layer and electric characteristics of the entire light-sensitive body, and also requires high accuracy for its form and surface condition. Therefore, when the foregoing light-sensitive layer becomes substantially unable to fulfil satisfactorily its function, the layer is desirable to be reused after removing the light-sensitive layer to be replaced by a new layer, whereby the manufacturing cost of the light-sensitive body can be largely reduced.

U.S. Pat. No. 3,056,700 discloses a method for the removal of soot from the inside wall of a breeching of a boiler wherein the soot is removed in such a manner that water is sprayed into the breeching, and then the water is abruptly heated to evaporate. This method, however, is rough and insufficient in that it is not useful for the complete removal of soot particles but useful only for water-absorbent adherent layers. Where a coating layer is a nonpermeable material such as the selenium light-sensitive layer, the method is nearly ineffective because any liquid cannot permeate.

There have been several known methods for removing a selenium light-sensitive layer from the support thereof. For example, U.S. Pat. No. 2,816,008 describes a method for the removal with the use of a fused alkali metal oxide; U.S. Pat. No. 3,837,815 describes the removal in such a manner that the light-sensitive body cooled in liquid nitrogen is immersed in water to form an ice layer thereon, and then the ice layer together with the light-sensitive layer is peeled off; U.S. Pat. No. 3,990,907 describes the use of such a solvent as water, trichloroethylene, perchloroethylene and the like heated to soften the selenium light-sensitive layer and then the layer is removed; and Japanese Patent Publication Open to Public Inspection (hereinafter referred to as Japanese Patent O.P.I. Publication) NO. 147703/1978 describes the use of a liquid containing an amine or mercaptan to remove the selenium light-sensitive layer.

The above-described methods, however, have such disadvantages as described below:

In a method for chemically removing the selenium light-sensitive layer from the support with the use of chemical agents, selenium or a selenium alloy is reacted with the foregoing chemical agent to produce a poisonous compound, or is dissolved in the agent to be prone to become a poisonous compound, and when such compounds are discharged as wastes there is the possibility of causing a pollution, so that the method requires large recovery equipment. And there are cases where a metallic support used as a conductive support becomes changed in quality or corroded chemically by the foregoing agent, resulting in failure to recover the foregoing support in any favorable condition.

Even in the method wherein the selenium light-sensitive layer is cooled to be peeled off using liquid nitrogen, there is such a disadvantage that the stress caused by the abrupt contraction is produced to bring about a distortion or a crack on the support.

Further, in practice, the removal effect of the light-sensitive layer is largely affected by the surface condition of the support depending on method. For example, a method that is effective for the removal of the light-sensitive layer on a support having a mirrorlike surface or surface with nearly mirrorlike smoothness may sometimes be of little or no effect on the selenium light-sensitive layer on such a support having a rough surface as described in Japanese Patent O.P.I. Publication No. 98327/1975. Such a drawback is particularly significant in the method of removing the light-sensitive layer in the aforesaid manner of softening by heating.

In view of the above-described situation, it is an object of the present invention to provide a method capable of removing very simply and securely the nonpermeable coating layer comprising a nonpermeable material from the substrate thereof.

It is another object of the present invention to provide a method capable of removing the coating layer without giving any chemical change to the component material of the coating layer and so that the substrate can be recovered in a favorable condition without being harmed.

It is still another object of the present invention to provide a method capable of removing securely the coating layer regardless of the surface condition of the substrate, thus being excellent in adaptability.

The remarkable object of the present invention is to provide a method for removing the coating layer capable of being favorably applied to the very effective removal of the selenium light-sensitive layer from the support thereof.

In the present invention, the nonpermeable coating layer comprised of a nonpermeable material formed on a substrate can be removed from the said substrate in such a manner that the nonpermeable coating layer is caused to become cracked and into the resulting cracks is introduced a volume expansive material that expands upon being subjected to a volume expansion treatment;

the treatment leads to the removal of the coating layer from the substrate.

More particularly, for example, in the case of removing the light-sensitive layer of a light-sensitive body wherein a selenium light-sensitive layer is formed on a metal support, in the present invention, the light-sensitive layer is first caused to become cracked. The formation of cracks may be accomplished in such manners as exposing the light-sensitive layer to ultraviolet rays, placing the layer under increased or reduced pressure, giving a shock to or heating or cooling the layer. Of these manners, the utilization of the change in volume due to the heating or cooling is most suitable; to be concrete, the entire light-sensitive body should be left in either a high temperature atmospheric condition of, e.g., 50° to 100° C. for a period of from 1 to 60 minutes or a low temperature atmospheric condition of about −20° to −200° C. for a period of from seconds to 30 minutes. Some selenium light-sensitive layer may sometimes be crystallized in these processes, and the change in the crystallized density can be valid for the formation of such cracks.

The above-described crack formation may in most cases be effectively made when promptly carried out in order to give a sudden environmental change to the light-sensitive layer, or alternatively, is even more effectively made by the use of combination of two or more processes, e.g., placing the light-sensitive body in a high temperature atmosphere and then in a low temperature atmosphere.

The crack or fissure to be formed by such crack forming manners is permitted to be such one into which the hereinafter described volume expansive material can intrude, and need not be observed by the naked eye, although it is essential that fine cracks are practicably formed over the entire area of the light-sensitive layer to be removed.

A volume expansive material is subsequently introduced by an appropriate volume expansion treatment into the cracks formed in the manner described above.

The herein-mentioned volume expansive material, in the case of removing a selenium light-sensitive layer, should preferably be such material as not corroding or dissolving nor giving any chemical change to the selenium compound, the component of the light-sensitive layer, which volume expansive material is typified by examples given below:

I. Materials whose volume expands as a result of the change in the condition of the phase due to a temperature change:

A. Liquids whose boiling point is relatively low, so that they can be easily vaporized by heating. Examples of such liquids are:

(1) water
(2) alcohols: methyl alcohol, ethyl alcohol, etc.
(3) hydrocarbons: propane, pentane, benzene, toluene, etc.
(4) halogenated hydrocarbons: monochlor methane, dichlor methane, trichlor methane, monochlor ethane, dichlor ethane, trichlor ethylene, various freons, etc.
(5) ketones: acetone, methyl ethyl ketone, etc.
(6) ethers: dimethyl ether, diethyl ether, etc.
(7) asters: methyl acetate, ethyl acetate, etc.

B. Liquids whose freezing point is relatively high, so that they can be easily solidified with volume expansion by cooling. A typical example is water.

II. Materials whose volume expands by the gas produced from a chemical change in a relatively simple treatment. Examples of such materials are:

(1) peroxides:

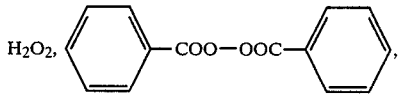

$C_{11}H_{23}COO—OOCC_{11}H_{23}$, and the like.

(2) nitrites or nitrates: $(NH_4)_2NO_2$, $KNO_3$, $NH_4NO_3$, and the like.
(3) perchlorates: $KClO_4$, $NH_4ClO_4$, and the like.
(4) carbonates: $NaHCO_3$, $NH_4HCO_3$, $(NH_4)_2CO_3$, and the like.
(5) azo compounds:

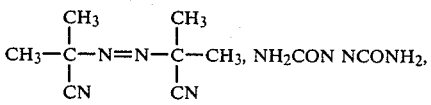

and the like.

(6) azide compounds: $CaN_6$, $BaN_6$, and the like.
(7) sulfonyl hydrazide compounds:

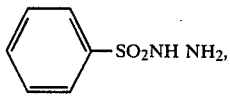

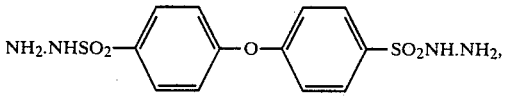

and the like.

(8) nitroso compounds:

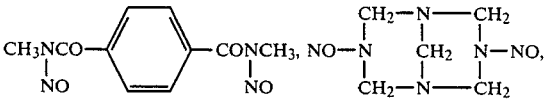

and the like.

(9) fulminates: $Hg(ONC)_2$, AgONC, and the like.
(10) polynitro compounds:

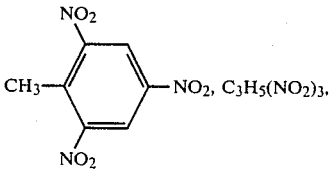

and the like.

(11) compounds having an isocyanate group such as $OCN(CH_2)_4NCO$,

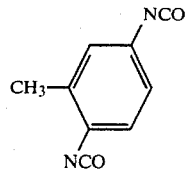

and the like, whose volume expands producing gas upon the reaction with water, carboxylic acids and the like.

Such volume expansive materials as enumerated above show abrupt changes in their volume expansions by being subjected to a temperature-change treatment, treatment with corresponding chemical agents, or other specific volume expansion treatments. As the volume expansive material, not only one kind but two or more kinds which expand by the same volume expansion treatment may also be used. When oxidizable materials (including materials which release oxidizable materials) or reducible materials (including materials which release reducible materials) are used as volume expansive materials, for the volume expansion treatment there may be effectively used reducible materials or oxidizable materials respectively, and a mixture of an oxidizable material with reducible material may also be used as the volume expansive material.

In order to bring the above volume expansive material into the cracks formed on the light-sensitive layer, if the material is a liquid, immersing the whole light-sensitive body in the liquid is most efficient, while if the material is a solid, the material should be immersed in a solution of the material or a dispersion liquid into which the solid material is dispersed.

In order to accelerate the intrusion of the volume expansive material there may be applied various procedures such as, for example, the addition of an anionic surfactant, cationic surfactant, nonionic surfactant and the like to the volume expansive material in the liquid form or a liquid containing the volume expansive material; or the application of a vigorous agitation or ultrasonic waves to the volume expansive material in the liquid form or a liquid containing the volume expansive material into which the light-sensitive body is immersed.

Both the foregoing formation of cracks and the intrusion of the volume-expansive material can also be carried out in a same process. For example, when a liquid volume-expansive material is heated and into this the photosensitive body is immersed, the formation of cracks and the intrusion of the foregoing volume-expansive material are carried out simultaneously. And particularly, in the selenium light-sensitive layer, the intrusion of the volume-expansive material can be accomplished highly efficiently in the state of being heated.

After the volume-expansive material is thus brought into the crack, a vlume expansion treatment takes place to cause the foregoing material to expand. The treatment operation comprises an appropriate temperature-change treatment, chemical agent treatment and the like, whose conditions may be arbitrarily selected depending on the kind, quantity or others of the volume-expansive material used.

The volume expansion caused by the volume expansion treatment is preferred to be performed very abruptly; to be more concrete, such a sudden change in temperature should be applied as, for example, in the manner of putting the light-sensitive body into a liquid volume-expansive material heated to a temperature exceeding the boiling point thereof. And the treatment liquid herein used, if it utilizes only the vaporization of the volume-expansive material, is desired to be one not dissolving or not miscible with the volume-expansive material.

The volume expansion treatment causes the volume-expansive material introduced into the cracks of the light-sensitive body to expand, and the expanding force causes the light-sensitive layer to become removed with being crushed from the support, thus attaining the removal of the light-sensitive layer.

Since the present invention is as has been illustrated, the nonpermeable coating layer comprised of a nonpermeable material formed on the surface of a substrate; e.g., the selenium light-sensitive layer formed on a support, can be removed readily, securely and sufficiently. This is because, in the process of producing cracks on the light-sensitive layer, not merely are cracks produced on the light-sensitive layer but a gap is formed at the interface between the light-sensitive layer and the support and into the gap part of the volume-expansive material intrudes, and at the same time, in the volume expansion treatment, the mechanical strength of the light-sensitive layer becomes weak due to the formation of the crack, so that the layer becomes crushed by the expanding pressure to be peeled away.

The method of the present invention, since the light-sensitive material is peeled off and thus removed by the pressure of the volume-expansive material, does not give any chemical change to the material that forms the foregoing light-sensitive layer, and therefore requires no consideration for any post-treatment which may be complex or expensive, and not only that, the light-sensitive layer has become weak due to the formation of cracks, the foregoing pressure acts preponderantly on the foregoing light-sensitive layer, thus enabling to avoid any chemical and physical changes to the support as well.

And even if the volume-expansive material is accompanied by a chemical change during its expansion, such a condition as not having any chemical effect on the light-sensitive layer as well as the support throughout the whole expansion process is readily selectable.

As has been mentioned, because the exfoliation of the light-sensitive layer, so to speak, is carried out by the force from the inside or internal side of the light-sensitive layer, all the light-sensitive layer can be nearly completely removed regardless of whether the surface of the support is rough or smooth.

Since every process in the present invention can be carried out simply and in a short period, it is very inexpensive, and further an appropriate selection of the conditions of the volume-expansive material and each process makes possible to further advantageously attain the objective removal of the light-sensitive layer. Concurrently, as mentioned earlier, the support may be recovered in a suitable condition without doing harm thereto, so that the support can be reused as it is.

As has been illustrated, the method of the present invention is very suitable for the removal of the light-sensitive material in the selenium light-sensitive body. The selenium light-sensitive body herein described means a light-sensitive body provided for the electrophotographic process and the like, which has a support provided thereon with a light-sensitive layer containing principally a noncrystal selenium or an alloy thereof.

Examples of the light-sensitive layer material are noncrystal selenium or an alloy or a mixture of selenium with lithium, fluorine, sodium, silicon, phosphorus, sulfur, chlorine, potassium, iron, copper, zinc, gallium, germanium, arsenic, bromine, rubidium, silver, cadmium, indium, tin, antimony, tellurium, iodine, cesium, gold, mercury, thallium, lead or bismuth or inorganic compounds such as oxides or halides of these elements, or with various organic compounds, and to any of these the method of the present invention is suitably applicable.

The present invention is useful for the removal of not only the light-sensitive layer of the selenium light-sensitive body but also the coating layer comprising a nonpermeable material that is formed on the surface of a substrate composed generally of a metal and the like; i.e., the coating layer comprising a material into the system of which any liquid cannot permeate in normal ways, so that swelling of the material may not take place. Such coating layers, aside from the foregoing selenium light-sensitive layer, include an amorphous or glassy vaporized layer, coated layer and annealed layer comprising silicon, indium oxide, aluminum oxide and the like, and also nonpermeable coating layer comprising organic as well as inorganic materials. These layers may also be satisfactorily removed from the substrate thereof in quite the same manner as in the case of the aforementioned selenium light-sensitive layer.

The present invention is illustrated further in detail below, but the present invention is not limited thereto. In addition, the "%" hereafter shown represents "% by weight."

EXAMPLE 1

An aluminum drum having the peripheral surface with the roughness of 0.5 μS was washed, and the drum as a support was provided on the peripheral surface thereof with an evaporated layer of noncrystal selenium with the purity of 99.999% by the normal vacuum evaporation method so that the layer thickness is about 65μ, thereby producing an electrophotographic light-sensitive body having the selenium light-sensitive layer. The characteristics of the resulting light-sensitive body was satisfactory as an electrophotographic light-sensitive body. The light-sensitive body was applied to a running process of 50,000 copy makings, and after that, was subjected to the procedure of removing the light-sensitive layer in the subsequent process in accordance with the present invention.

The above light-sensitive body was first allowed to stand for three minutes in a thermostat whose temperature was kept at 150° C., then the light-sensitive layer was found to have fine cracks throughout the entire area thereof.

The light-sensitive body was subsequently immersed for one minute in water at room temperature, and thereafter was immersed for 10 seconds in a boiling tetrachlor ethylene, then the light-sensitive layer was nearly completely removed from the drum surface. The condition of the thus obtained aluminum drum was the same as it was before the formation of the foregoing light-sensitive layer, and the drum was reused as a support to form thereon a light-sensitive layer comprised of selenium similar to the initial one, whereby an electrophotographic light-sensitive body having likewise satisfactory characteristics was obtained.

Control 1

Two electrophotographic sensitive bodies each having a light-sensitive layer were produced in a similar manner to that in Example 1, and the bodies each was subjected to a running process of 50,000 copy makings, and afterward an attempt was made to remove the light-sensitive layer in accordance with the following procedure:

One light-sensitive body was tried to be subjected to the removal of the light-sensitive layer in an identical manner with that of Example 1 with the exception that the process for the formation of cracks on the light-sensitive layer was omitted, but no removal of the light-sensitive body was found. Then the immersing time of the body in tetrachlor ethylene was prolonged by one hour, but the removed portion of the layer was 10% or less of the entire area.

As for the other light-sensitive body, an attempt was made to remove the light-sensitive layer in an identical process with that of Example 1 with the exception that the immersing was omitted, but the removal of the light-sensitive layer was not found at all, either, and even when immersed in the tetrachlor ethylene prolonging by one hour, the removed portion of the layer was only 5% of the entire area.

EXAMPLE 2

An aluminum drum having the peripheral surface with the roughness of 0.3 μS was washed, and on the peripheral surface as a support was deposited a selenium-tellurium alloy containing mean 12.04% tellurium in the normal vacuum evaporation manner so that the deposited thickness was 6.5μ, thereby producing an electrophotographic light-sensitive body having the selenium-tellurium light-sensitive layer. The characteristics of the resulting light-sensitive body was satisfactory as an electro-photographic light-sensitive body. This light-sensitive body was applied to a running process of 50,000 copy markings, and then the removal of the light-sensitive body was carried out in a similar manner to that in Example 1.

The condition of the thus obtained aluminum drum is the same as it was before the formation of the foregoing light-sensitive layer. The drum was reused as a support to form thereon a light-sensitive layer comprising the selenium-tellurium alloy similar to the initial one, whereby an electro-photographic light-sensitive body having likewise satisfactory characteristics.

EXAMPLE 3

An aluminum drum having the peripheral surface with the roughness of 0.8 μS was washed, and on the peripheral surface as a support was deposited a selenium-arsenic alloy containing mean 0.52% arsenic in the normal vacuum evaporation method so that the thickness is about 70μ, whereby an electrophotographic light-sensitive body having a selenium-arsenic light-sensitive layer. The characteristics of the resulting light-sensitive body was satisfactory as an electrophotographic light-sensitive body. The light-sensitive body was applied to a running process of 50,000 copy makings, and then the light-sensitive layer was removed in the following process in accordance with the present invention.

The above light-sensitive body was first placed for about five minutes in a low temperature thermostat whose temperature was kept at −50° C., then the light-sensitive layer was found to have fine cracks over the entire area thereof.

The light-sensitive body was subsequently immersed for one minute in water at room temperature, and then immersed for 10 seconds in tetrachlor ethylene kept at the temperature of −10° C., then nearly all the light-sensitive layer was removed from the surface of the drum. The condition of the thus obtained aluminum is the same as it was before the formation of the foregoing light-sensitive layer. The drum was reused as a support to form thereon a light-sensitive layer comprising selenium-arsenic alloy similar to the initial one, thereby obtaining an electrophotographic light-sensitive body having likewise satisfactory characteristics.

Control 2

Two electrophotographic light-sensitive bodies each having thereon a light-sensitive layer comprising a selenium-arsenic alloy were produced in a similar manner to that of Example 3, and the light-sensitive bodies each was applied to a running process for 50,000 copy makings in a similar manner to that of Example 3 and thereafter an attempt was made to remove the light-sensitive layer in the subsequent process.

One light-sensitive body was tried for the removal of the light-sensitive layer in an identical process with that of Example 3 with the exception that the immersion in water was omitted, but the layer was not removed at all.

As to the other light-sensitive body the removal of the light-sensitive layer was tried in quite the same manner as in Example 3 with the exception that the process for placing the body in the low-temperature thermostat was omitted, but the light-sensitive layer was not removed at all, either.

EXAMPLE 4

An aluminum drum having the peripheral surface with the roughness of 1.5 μS was washed, and on the peripheral surface as a support was formed aluminum hydroxide crystals (Boehmite) to be a barrier layer (see Japanese Patent O.P.I. Publication No. 11692/1979), on which was deposited a selenium-tellurium alloy containing mean 7.50% tellurium in the normal vacuum evaporation manner, thus producing an electrophotographic light-sensitive body having the selenium-tellurium alloy. The characteristics of the resulting light-sensitive body was satisfactory as an electrophotographic light-sensitive body. The light-sensitive layer was applied to a running process for 60,000 copy makings, and then the light-sensitive layer was removed in the following procedure in accordance with the present invention.

The above photo-sensitive body was immersed for five minutes in a boiling tetrachlor ethylene, then the occurrence of fine cracks throughout the entire area of the light-sensitive layer was found.

The light-sensitive body was immersed for one minute at room temperature in a methylene chloride solution to which was added 1% azo-bis-isobutylonitrile and was subsequently immersed for 10 seconds in a boiling tetrachlor ethylene, then nearly all the light-sensitive layer was removed from the surface of the drum.

The condition of the thus obtained aluminum drum is the same as it was before the formation of the foregoing light-sensitive layer. The drum was reused as a support to form thereon a light-sensitive layer comprising the selenium-tellurium alloy similar to the initial one, whereby an electrophotographic light-sensitive body having likewise satisfactory characteristics.

Control 3

Two electrophotographic light-sensitive bodies each having a light-sensitive layer comprising sellenium-tellurium alloy were produced, and the bodies each was applied to a running process for 60,000 copy makings and in the following process an attempt was made to remove the light-sensitive layer.

One light-sensitive body was immersed in methylene chloride in place of the methylene chloride solution to which was added azo-bis-isobutylonitrile, and, except this, was tried for the removal of the layer in quite the same process as in Example 4, but the removal portion of the layer was at the most 50% of the entire area. This is considered due to the fact that methylene chloride, a volume expansive material, dissolvable in tetrachlor ethylene does not expand effectively when intruding into the cracks of the light-sensitive layer.

As to the other light-sensitive body, an attempt was made to remove the light-sensitive layer in a similar process to that of Example 4 with the exception that the crack forming process by the immersion of the body in tetrachlor ethylene was omitted, but the light-sensitive layer was not removed at all.

We claim:

1. A method of treating a substrate having a nonpermeable coating layer thereon, said method consisting essentially of (1) exposing said substrate to a first high temperature of from about 50° C. to about 150° C. to produce cracks in said layer, then (2) immersing said coated substrate in a volume expansive liquid so that said liquid is introduced into the cracks, and then (3) exposing said substrate to a second high temperature which is above the boiling point of said expansive liquid to cause volume expansion of said liquid introduced into the cracks, whereby said coating layer is removed from said substrate.

2. The method of claim 1 wherein Steps 1 and 3 take place in hot tetrachloroethylene.

3. The method of claim 2 wherein said volume expansive liquid is immiscible with tetrachloroethylene.

4. The method of claim 2 wherein said volume expansive liquid has a boiling point lower than that of tetrachloroethylene.

5. The method of claim 2 wherein said volume expansive liquid is water.

6. The method of claim 1 wherein said layer is a photosensitive selenium layer for an electrophotographic photoreceptor.

7. The method of claim 3 wherein said layer is a photosensitive selenium layer for an electrophotographic photoreceptor.

8. The method of claim 4 wherein said layer is a photosensitive selenium layer for an electrophotographic photoreceptor.

9. A method of treating a substrate for an electrophotographic photoreceptor having a photosensitive selenium coating layer thereon comprising (1) immersing said substrate in boiling tetrachloroethylene for a period of from 1 to 60 minutes, then (2) immersing said substrate in a liquid which is immiscible with tetrachloroethylene and which has a lower boiling point than that of tetrachloroethylene, and then (3) immersing said coated substrate in boiling tetrachloroethylene, whereby said photosensitive selenium layer is removed from said substrate.

* * * * *